US007156003B2

(12) United States Patent
Cole

(10) Patent No.: US 7,156,003 B2
(45) Date of Patent: Jan. 2, 2007

(54) RADIAL INDEXING HEAD TOOL WITH FLOATING SPLINED PIN

(76) Inventor: Charles A. Cole, 3621 Trail View Dr., Plano, TX (US) 75074

( * ) Notice: Subject to any disclaimer, the term of this patent is extended or adjusted under 35 U.S.C. 154(b) by 184 days.

(21) Appl. No.: 11/033,331

(22) Filed: Jan. 11, 2005

(65) Prior Publication Data

US 2005/0178249 A1 Aug. 18, 2005

Related U.S. Application Data

(63) Continuation-in-part of application No. 10/339,614, filed on Jan. 9, 2003, now Pat. No. 6,840,141.

(51) Int. Cl.
*B25B 23/16* (2006.01)

(52) U.S. Cl. ..... 81/177.8; 81/58.3; 403/97

(58) Field of Classification Search ..... 81/177.7, 81/177.8, 60, 58, 58.1, 58.3, 440; 403/91–93, 403/95–97, 298

See application file for complete search history.

(56) References Cited

U.S. PATENT DOCUMENTS

| | | | |
|---|---|---|---|
| 151,315 | A | 5/1874 | Rowe |
| 624,643 | A | 5/1899 | Gaylor |
| 662,966 | A | 12/1900 | Robertson |
| 928,375 | A | 7/1909 | Fricke |
| 1,077,575 | A | 11/1913 | Wutke |
| 1,109,032 | A | 9/1914 | Berstead |
| 1,217,217 | A | 2/1917 | Reagan, Jr. |
| 1,286,506 | A | 12/1918 | Berry |
| 1,355,455 | A | 10/1920 | Doughty |
| 1,568,442 | A | 1/1926 | Carver |
| 1,840,685 | A | 1/1932 | Witherup |
| 2,420,132 | A | 5/1947 | Gryiuck |
| 2,638,677 | A | 5/1953 | Sheriff |
| 2,671,367 | A | 3/1954 | Modin |
| 2,691,316 | A | 10/1954 | Brame |
| 2,708,855 | A | 5/1955 | Fish |
| 2,921,773 | A | 1/1960 | Hoelzer |
| 3,002,409 | A | 10/1961 | Jones |
| 3,039,339 | A | 6/1962 | Hanson |
| 3,119,591 | A | 1/1964 | Malecki |
| 3,175,436 | A | 3/1965 | Coleman |
| 3,188,895 | A | 6/1965 | Jones |
| 3,270,597 | A | 9/1966 | Neff et al. |
| 3,314,318 | A | 4/1967 | Shoults |
| 3,550,486 | A | 12/1970 | Edwards |
| 3,733,936 | A | 5/1973 | Flynn |
| 3,779,107 | A | 12/1973 | Avery |

(Continued)

FOREIGN PATENT DOCUMENTS

| | | |
|---|---|---|
| WO | WO 95/34408 | 12/1995 |

(Continued)

*Primary Examiner*—Hadi Shakeri

(57) ABSTRACT

The present invention relates to an indexing mechanism which provides a releasing function to permit the rotation of tool and handle members relative to each other. The indexing mechanism is positioned through two extensions positioned on either the tool or the handle and a third member positioned between the two extensions. Each of the two extensions and the central member includes a splined orifice. A splined pin is positioned in the splined orifices and is moveable to permit release or engagement of the handle and the tool so that the handle and the tool can be released for rotation relative to each other and re-engaged to form a rigid connection between the tool and the handle. The indexing mechanism of the present invention minimizes sticking of the splined pin during release and re-engagement.

16 Claims, 9 Drawing Sheets

U.S. PATENT DOCUMENTS

| | | | |
|---|---|---|---|
| 3,854,832 | A | 12/1974 | Cowper |
| 4,145,124 | A | 3/1979 | Weisgerber |
| 4,184,783 | A | 1/1980 | Hall |
| 4,244,237 | A | 1/1981 | Sprunger |
| 4,270,417 | A | 6/1981 | Tesoro |
| 4,281,601 | A | 8/1981 | Overman |
| 4,406,186 | A | 9/1983 | Gummow |
| 4,479,409 | A | 10/1984 | Antonius |
| 4,520,697 | A | 6/1985 | Moetteli |
| 4,543,007 | A | 9/1985 | Quiogue |
| 4,582,445 | A | 4/1986 | Warshawsky |
| 4,596,167 | A | 6/1986 | White, Jr. |
| 4,614,452 | A | 9/1986 | Wang |
| 4,619,540 | A | 10/1986 | Day et al. |
| 4,657,428 | A | 4/1987 | Wiley |
| 4,711,596 | A | 12/1987 | Bruderer |
| 4,747,328 | A | 5/1988 | Howard |
| 4,774,862 | A | 10/1988 | Scull |
| 4,794,829 | A | 1/1989 | Mesenhoeller |
| 4,800,785 | A | 1/1989 | Christensen |
| 4,805,494 | A | 2/1989 | Santoro |
| 4,901,608 | A | 2/1990 | Shieh |
| 4,921,271 | A | 5/1990 | Berry et al. |
| 4,929,113 | A | 5/1990 | Sheu |
| 4,982,732 | A | 1/1991 | Morris |
| 4,991,470 | A | 2/1991 | Singleton |
| 4,993,862 | A | 2/1991 | Pelta |
| 5,039,118 | A | 8/1991 | Huang |
| 5,056,805 | A | 10/1991 | Wang |
| 5,062,179 | A | 11/1991 | Huang |
| 5,123,768 | A | 6/1992 | Franklin |
| 5,197,817 | A | 3/1993 | Wood et al. |
| 5,326,186 | A | 7/1994 | Nyberg |
| 5,386,747 | A | 2/1995 | Grover |
| 5,419,221 | A | 5/1995 | Cole |
| 5,471,899 | A | 12/1995 | Twomlow |
| 5,503,048 | A | 4/1996 | Moon |
| 5,522,287 | A | 6/1996 | Chiang |
| 5,564,852 | A | 10/1996 | Maxwell et al. |
| 5,581,838 | A | 12/1996 | Rocco |
| 5,674,024 | A | 10/1997 | Daumal Castellor |
| 5,694,818 | A | 12/1997 | Nickipuck |
| 5,775,184 | A | 7/1998 | Cole |
| 5,820,288 | A | 10/1998 | Cole |
| 5,879,100 | A | 3/1999 | Winkler |
| 5,911,800 | A | 6/1999 | Roberts et al. |
| 5,941,141 | A | 8/1999 | Whitley |
| 6,000,299 | A | 12/1999 | Cole |
| 6,032,555 | A | 3/2000 | Whitley |
| 6,161,982 | A | 12/2000 | Cole |
| 6,216,565 | B1 | 4/2001 | McCann |
| 2004/0202506 | A1* | 10/2004 | Lazic et al. ..... 403/97 |

FOREIGN PATENT DOCUMENTS

| | | |
|---|---|---|
| WO | WO 98/48178 | 10/1998 |
| WO | WO 99/16584 | 4/1999 |

* cited by examiner

RADIAL INDEXING HEAD TOOL WITH FLOATING SPLINED PIN

RELATED APPLICATIONS

This application is a continuation-in-part of U.S. Ser. No. 10/339,614 filed Jan. 9, 2003 by Charles A. Cole entitled "Radial Indexing Head Tool With Floating Splined Pin" now U.S. Pat. No. 6,840,141.

FIELD OF THE INVENTION

The present invention relates to hand tools and particularly to hand tools having members coupled together for movement relative to each other. More particularly, the invention relates to an indexing splined pin mechanism for releasably coupling the members.

BACKGROUND OF THE INVENTION

Devices for coupling two members together are well known. Many of these devices allow members to be coupled and adjusted to a desired position. However, existing devices suffer from many disadvantages wherein it is difficult to engage and disengage the coupler. For example, in some existing devices the coupler must be physically pressed to lock or unlock the coupler. In addition, when pressing the coupling device to engage or disengage, existing devices tend to bind. Therefore, a device has been needed which couples two members together, allows the coupler to be easily engaged and disengaged and does not bind.

U.S. Pat. No. 6,032,555 issued to Lowell Blake Whitley (Whitley) on Mar. 7, 2000, discloses one such solution wherein an indexable ratchet wrench has a splined pin that couples the ratchet head to the handle and includes a plurality of spline members moveable in the plane of the handle and ratchet head in response to rotation of an actuator. The spline members are spring loaded to a retracted position. Each spline member includes a camming surface which engages a cam lobe formed on the actuator. As the actuator is rotated about the axis of the splined pin, the cam lobes force the spline members radially outwardly from the axis of the splined pin to an engaged position. Unfortunately, the cam will eventually experience wear and provide only limited and weakened engagement of the spline members with the splined apertures. Additionally the plurality of moving parts linked by a spring makes the tool susceptible to jamming and misalignment.

A distinct advantage would be achieved by producing a coupler with a spring loaded splined pin using a minimum number of moving parts. It would be especially advantageous to produce a coupler which eliminates the need for cam lobes, which are susceptible to wear. This design would facilitate a longer and a more useful life span of the tool.

SUMMARY OF THE INVENTION

According to the claimed invention, an indexing mechanism for an indexable tool is disclosed. The tool has a handle, which is joined to a tool member with the indexing mechanism being adapted to enable moving the tool member and the tool handle to selected positions.

The invention further comprises an indexing mechanism for an indexable tool, the tool having a tool handle joined to a tool member with the indexing mechanism being adapted to enable indexing the tool member and the tool handle to selected positions, the indexing mechanism comprising: a) a first splined orifice having a splined section on its inner surface and having a width less than the length of the first orifice and positioned on a first end of the first splined orifice; b) a second splined orifice having a splined section on its inner surface and having a width less than the length of the second orifice and positioned on a first end of the second orifice; c) a third splined orifice having splines on its inner surface and being positioned between the first orifice and the second orifice; d) a splined pin assembly positioned in the third splined orifice to engage the splines on the inside surface of the third orifice and the splined sections of the first and second orifices when in an engaged position and to disengage from the splined sections of a first and second orifices when in the released position, the splined pin assembly comprising; 1) a splined pin having a first end and a second end, a first splined section and a second splined section separated by a first track and a plurality of extension arms on its second end, an outside of the extension arms forming a second track surface around the outside of the splined pin to form a second track around the splined pin; 2) an alignment member having a plurality of extended arms positioned to matingly engage the extension arms on the second end of the splined pin and having a connector receptacle; 3) a spring positioned in the splined pin; 4) a first end cap having on its inside an extension slideably connected to the alignment member; 5) a second end cap having an inside, a lip on its inside, an extension adapted to engage the spring so that the spring is in compression between the second end cap and the splined pin and a opening in the second end cap for a connector connecting the second end cap to the alignment member; and, 6) a connector connecting the second end cap to the alignment member wherein the first splined section is urged into the first track and the second splined section is urged into the second track when the first end cap is moved toward the second end cap to release the splined indexing mechanism, release of the first end cap returns the indexing mechanism to its engaged position.

The invention also comprises a tool, including an indexing member, and comprising a tool handle joined to a tool member with the indexing mechanism being adapted to enable indexing the tool member and the tool handle to selected positions wherein the indexing mechanism comprises: an indexing mechanism for an indexable tool, the tool having a tool handle joined to a tool member with the indexing mechanism being adapted to enable indexing the tool member and the tool handle to selected positions, the indexing mechanism comprising: a) a first splined orifice having a splined section on its inner surface and having a width less than the length of the first orifice and positioned on a first end of the first splined orifice; b) a second splined orifice having a splined section on its inner surface and having a width less than the length of the second orifice and positioned on a first end of the second orifice; c) a third splined orifice having splines on its inner surface and being positioned between the first orifice and the second orifice; d) a splined pin assembly positioned in the third splined orifice to engage the splines on the inside surface of the third orifice and the splined sections of the first and second orifices when in an engaged position and to disengage from the splined sections of a first and second orifices when in the released position, the splined pin assembly comprising; 1) a splined pin having a first end and a second end, a first spline section and a second splined section separated by a first track and a plurality of extension arms on its second end, an outside of the extension arms forming a second track surface around the outside of the splined pin to form a second track around the splined pin; 2) an alignment member having a plurality of extended arms positioned to matingly engage the extension arms on the second end of the splined pin and having a connector receptacle; 3) a spring positioned in the splined pin; 4) a first end cap having on its inside an extension slideably connected to the alignment member; 5) a second end cap having an inside, a lip on its inside, an extension adapted to engage the spring so that the spring is in compression between the second end cap and the splined pin and a opening in the second end for a connector connecting the second end cap to the alignment member; and, 6) a connector connecting the second end cap to the alignment member wherein the first splined section is urged into the first track and the second splined section is urged into the second track when the first end cap is moved toward the second end cap to release the splined indexing mechanism, release of the first end cap returns the indexing mechanism to its engaged position.

The tool can include first and second splined orifices on a handle with the third splined orifice being positioned on a tool member.

The tool may comprise first and second splined orifices positioned on a tool member with a third splined orifice member being positioned on a tool handle.

DETAILED DESCRIPTION OF THE INVENTION

Figure 1:
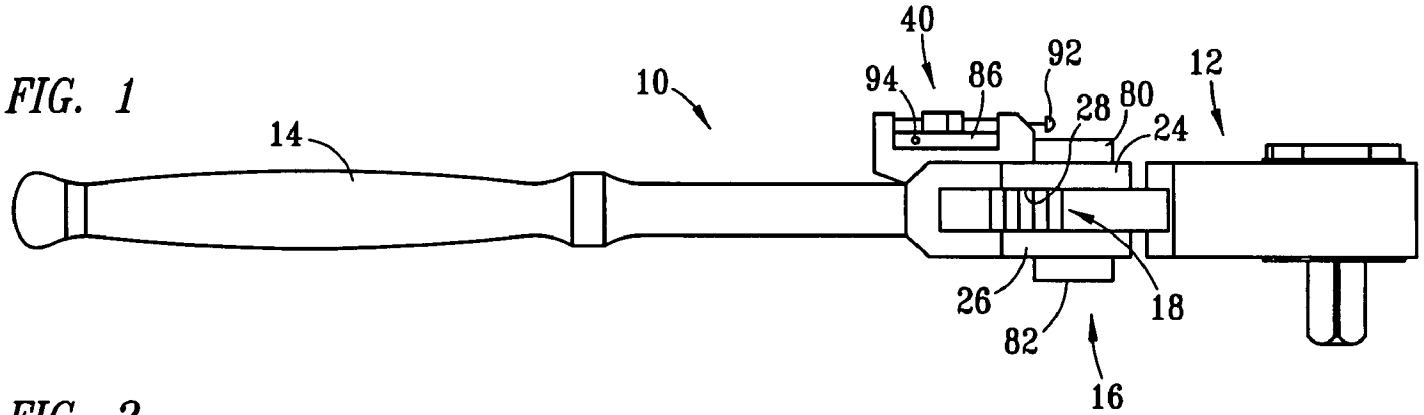
FIG. 1. is a side elevation view of an indexable wrench having a coupler in the preferred embodiment of the present invention.
Figure 2:
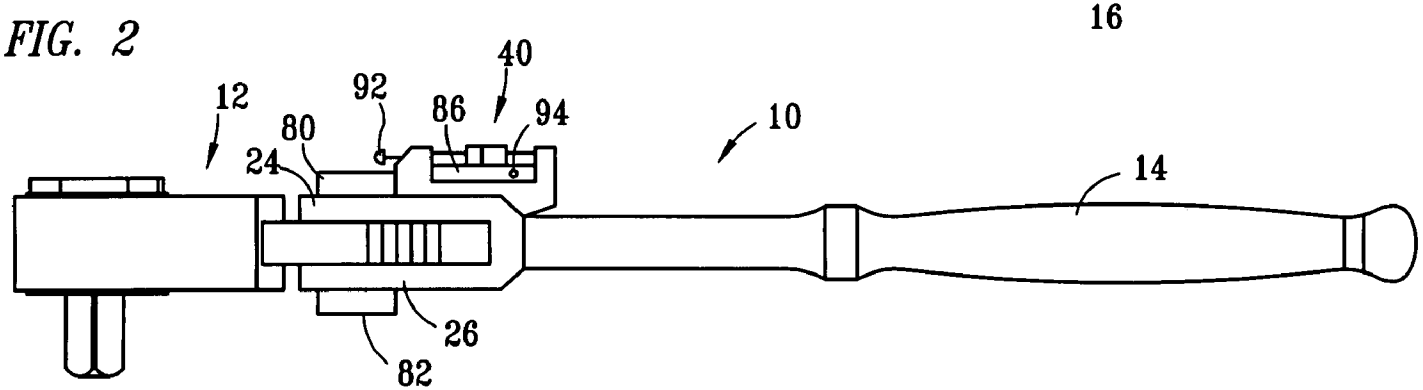
FIG. 2. is a side elevation view of a second side of the indexable wrench of FIG. 1.

In the description of the FIGS, the same numbers will be used throughout to refer to the same or similar components.

A radial indexing head tool with a floating splined pin 10 embodying certain features of the present invention, as illustrated in FIGS. 1–5, includes a tool head 12 coupled to a handle 14 by a splined pin assembly 16. The tool head 12, illustratively a ratchet head, includes an attaching member 18 having a splined orifice 22. The handle 14 includes an upper prong 24 and a lower prong 26. The prongs 24 and 26 are disposed in spaced-apart relation with a gap 28 therebetween for receiving the tool head attaching member 18. The upper and lower prongs 26 and 26 include splined orifices 32 and 34, respectively that coaxially align with the splined orifice 22 of the tool head 12. A locking device 40 is disposed on the handle 14 to engage the splined pin assembly 16 to lock and unlock the indexable wrench 10.

Figure 6:
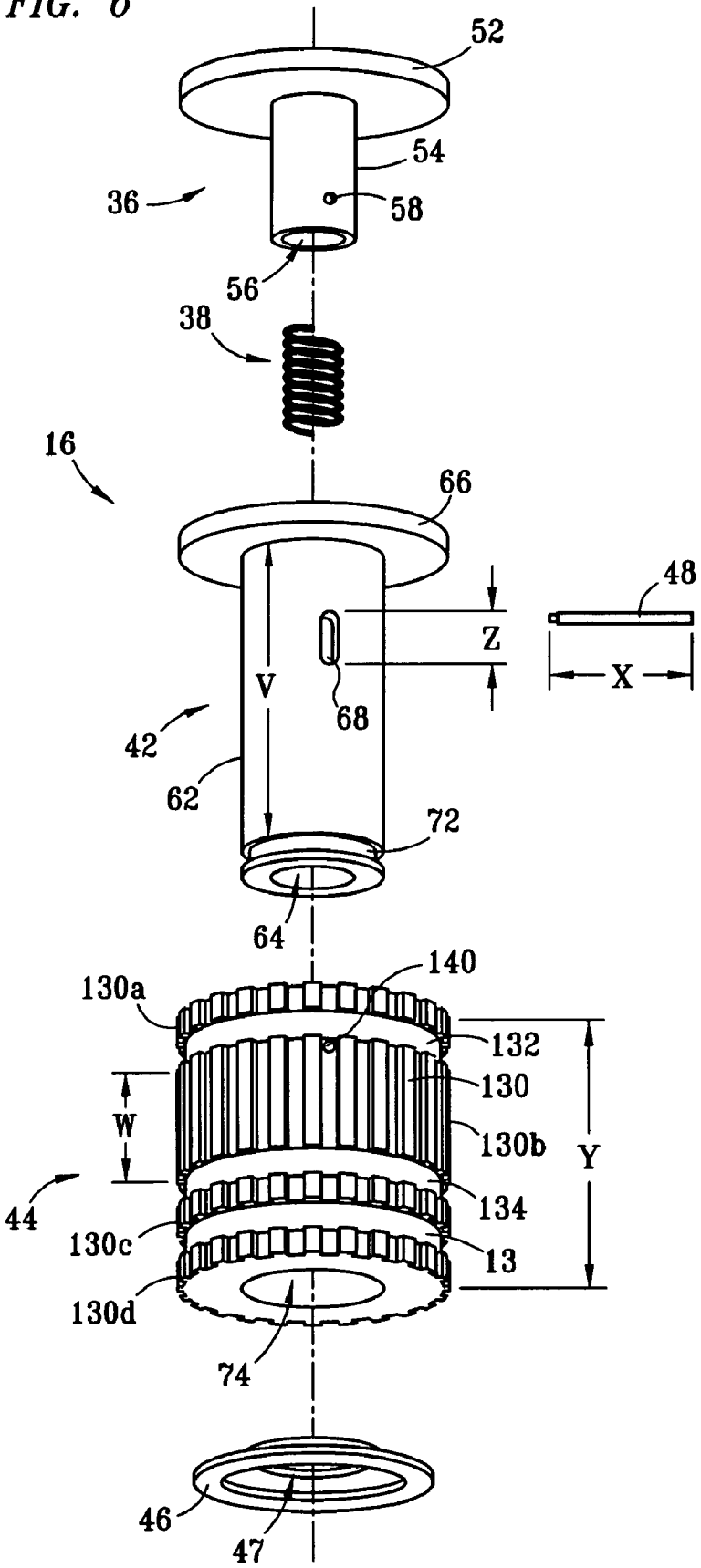
FIG. 6 is an exploded side perspective view of the splined pin.

As illustrated in FIG. 6, the splined pin assembly 16 includes a plunger 36, a coil spring 38, an axial retainer 42, a splined cylinder 44, a washer 46 and a retaining pin 48.

The plunger 36 includes a circular planar member 52 and a plunger cylinder 54 extending orthogonally from the planar member 52. A bore 56 which is sized to accommodate the coil spring 38, extends longitudinally through the center of the plunger cylinder 54. The plunger cylinder 54 includes two diametrically opposed apertures 58 which are sized to snugly receive the retaining pin 48.

The axial retainer 42 includes retainer cylinder 62 which has a central longitudinal bore 64, sized to accommodate the plunger cylinder 54 and a circular flange 66 extending radially outwardly from the top of the retainer cylinder 62. The flange 66 is approximately the same size and shape as the planar member 52. The retainer cylinder 62 further includes two diametrically opposed slots 68, each having a length Z and an annular channel 72 adjacent to the bottom. The length from the top of the retainer cylinder 62 to the annular channel 72 is V.

The splined cylinder 44 has a length Y and includes a central longitudinal bore 74 that is sized to accommodate the retainer cylinder 62 therein. The length Y of the splined cylinder is slightly less than the length V of the retainer cylinder 62. The splined cylinder 44 includes a plurality of longitudinally extending external splines 130, divided by circumferential grooves 132, 134 and 136. The grooves divide the splines 130 into splined portions 130*a*, 130*b*, 130*c* and 130*d*. In addition, the grooves have a depth equal to the height of the splines 130. The splined portions 130*a*, 130*c* and 130*d* have a width approximately equal to the width of the grooves. However, in a preferred embodiment, the width W of the splined portion 130*b* is substantially wider than the width of the other splined portions. In alternate embodiments of the present invention, the number and size of grooves and splined portions may vary and still provide the same functionality as explained below.

The splined cylinder 44 further includes two diametrically opposed apertures 140. Preferably the apertures 140 are located at an upper portion of the splined cylinder 44. The diameter of the splined cylinder 44 is also approximately equal to a length X of the retaining pin 48.

Figure 10:
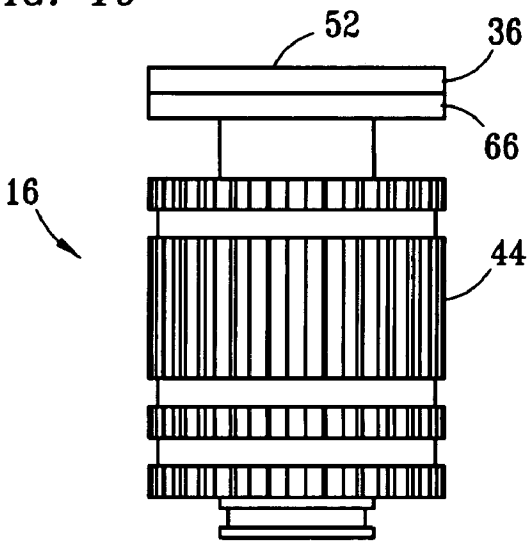
FIG. 10 is a side view of the assembled splined pin assembly with the plunger in a depressed position.
Figure 8:
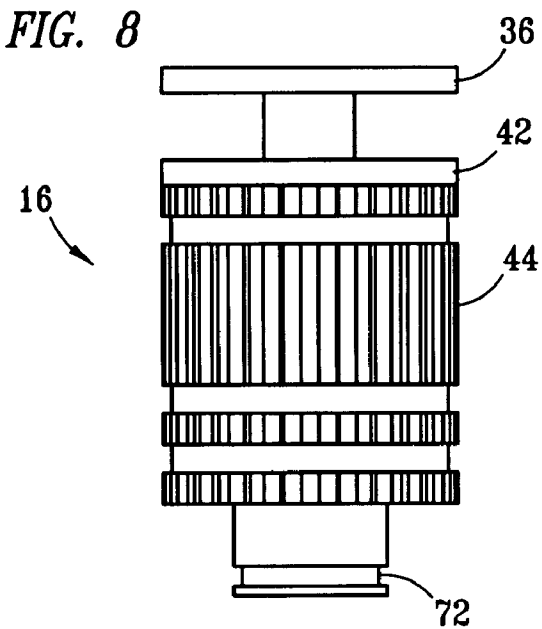
FIG. 8 is a side view of the assembled splined pin assembly with the plunger in an extended position.

When assembled as illustrated in FIGS. 8 and 10, the retainer cylinder 62 is positioned within the bore 74 of the splined cylinder 44. The coil spring 38 is inserted into the bore 64 of the retainer cylinder 62. The plunger 36 is then inserted into the bore 64. The splined pin assembly 16 is held in this assembled position by the retaining pin 38 which is inserted through the apertures 140, the slots 68 and the apertures 58. The coil spring forcibly presses the plunger upwardly. However, the pin 48 retains the plunger 36 within the bore 64 of the retainer cylinder 62 with the length Z of the slot 68 allowing some movement of the plunger 36. The pin 48 could be replaced by a bolt, screw or threaded rod or the like.

Figure 3:
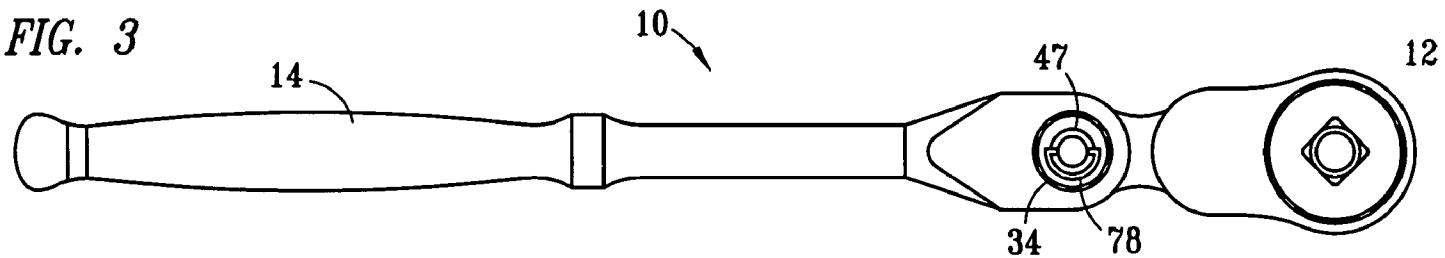
FIG. 3. is a bottom view of the indexable wrench without the locking device in the preferred embodiment of the present invention.
Figure 4:
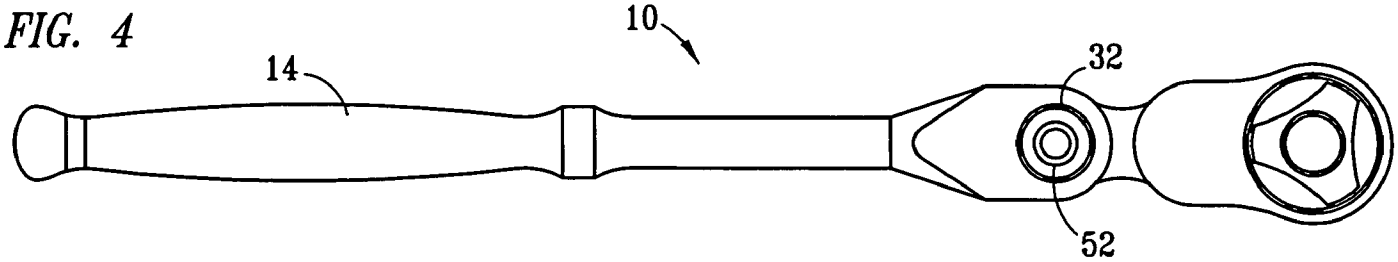
FIG. 4. is a top plan view of the indexable wrench without the locking device in the preferred embodiment of the present invention.
Figure 5:
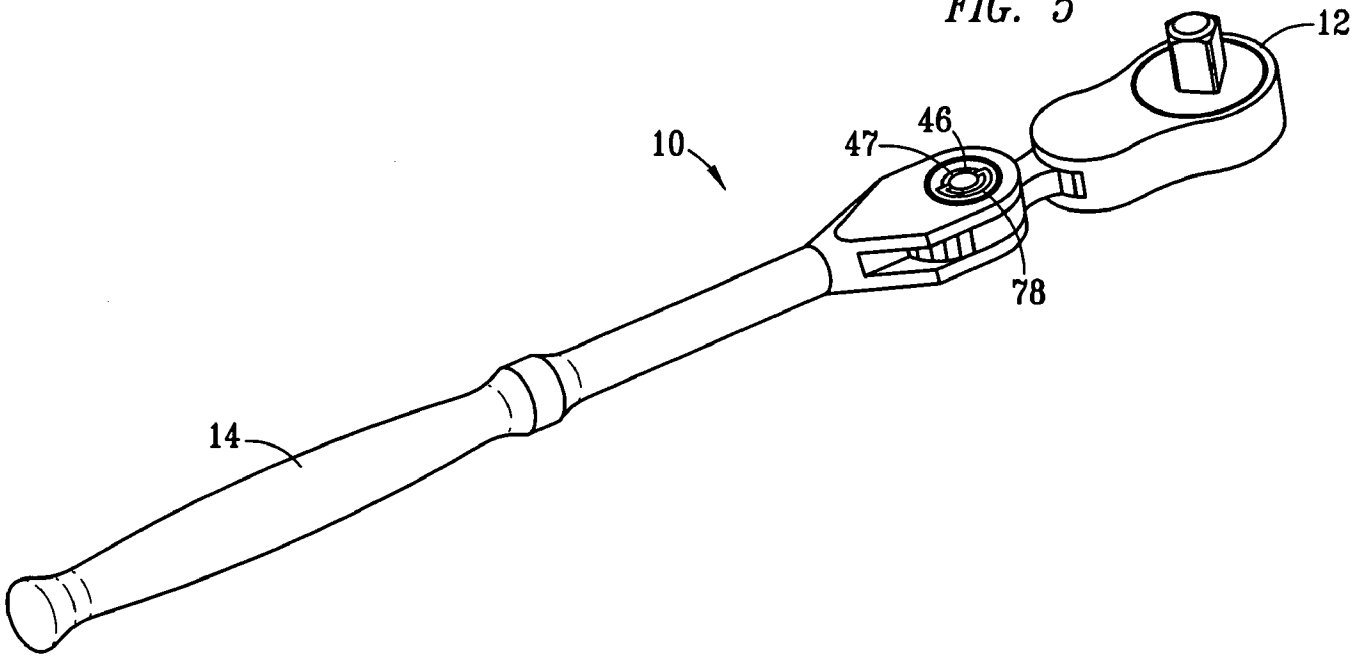
FIG. 5 is a bottom perspective view of the indexable wrench of FIG. 1 illustrating the center portion.

The annular channel 72 extends through the bottom of the splined cylinder. The washer 46, having an aperture 47 (FIGS. 3 and 5) is inserted on the lower portion of the retainer cylinder 62. The washer 46 is held in place by a U-shaped retainer 78 as shown in FIGS. 3–5.

Figure 16:
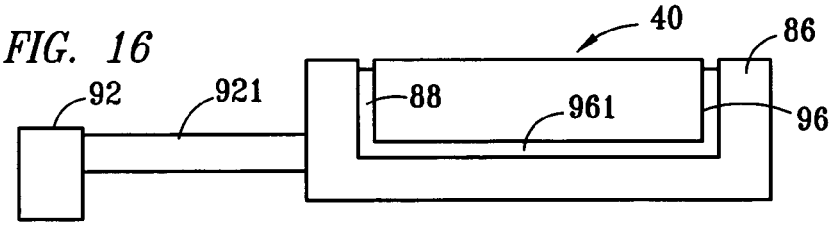
FIG. 16 is a side view of the cylinder of the locking device shown schematically in FIGS. 1 and 2.
Figure 17:
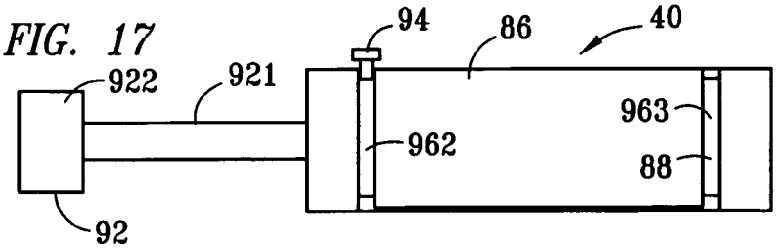
FIG. 17 is a top view of the locking device of FIG. 16.
Figure 18:
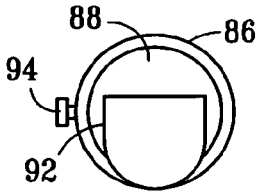
FIG. 18 is an end view of the locking device of FIG. 16.

As illustrated schematically in FIGS. 16–18, the locking device 40 is located on an upper portion of the handle 14, adjacent to the boss 80. The locking device 40 includes a cylinder 86, a piston 88, an eccentric cam 92 extending from the piston 88 parallel to and offset from the longitudinal axis of the piston 88, and an actuator 94 extending radially from the piston 88. The cylinder 86 includes a U-shaped channel 96 having a longitudinal portion 961 and first and second radial portions 962 and 963, respectively, extending orthogonally from the longitudinal portion 961. The eccentric cam 92 includes a shank 921 having a proximal end attached to the piston 88. A cam lobe 922 is disposed at the distal end of the shank 921. The piston 88 is operatively disposed for longitudinal and rotational movement in the cylinder 86 with the actuator 94 operatively disposed in the U-shaped channel 96. The locking device 84 is configured so that the eccentric cam 92 is extended to a first position for engaging the splined pin assembly 16 when the actuator 94 is disposed in the first radial portion 962.

Movement of the actuator 94 in the first radial portion 962 away from the longitudinal portion 961 rotates the shank 961 and cam lobe 922 about the longitudinal axis of the piston 88, brining the cam lobe 922 into engagement with splined pin assembly 16 to depress the plunger 36. Continued movement of the actuator 94 in the first radial portion 962 increases the amount of engagement and further depresses the plunger 36. Ultimately, the cam lobe 922 pushes downwardly on the plunger 36 sufficiently to move the splined cylinder 44 to an unlocked position. The eccentric cam 92 is retracted to a second position disengaged from the splined pin assembly 16 when the actuator 94 is moved along the longitudinal portion 961. The actuator 94 is moved into the second radial portion 963 to retain the eccentric cam 92 in the retracted position.

Figure 7:
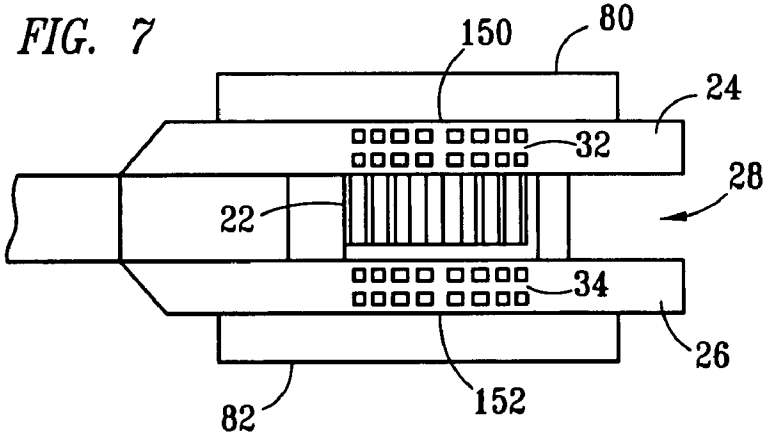
FIG. 7 is a partial cut-away side view of the splined pin inserted within the lower prong and the upper prong in the locked position.

FIG. 7 is a partial cut-away side view illustrating the splined aperture 22 in the tool head 12 and the apertures 32 and 34 in the upper and lower prongs 24 and 26, respectively. The upper prong 24 includes a circular boss 80 and the lower prong 26 includes a circular boss 82. Each orifice 32 and 34 is sized and configured to engage the splined cylinder 44.

FIG. 8 is a side view of the splined pin assembly 16 with the plunger 36 in an extended position. The coil spring 38 provides an upward force to the plunger 36 which separates the planar member 52 of the plunger 36 from the circular flange 66 of the axial retainer 42. The plunger 36 is limited in its upward movement by movement of the retaining pin 38 in the slots 68.

Figure 9:
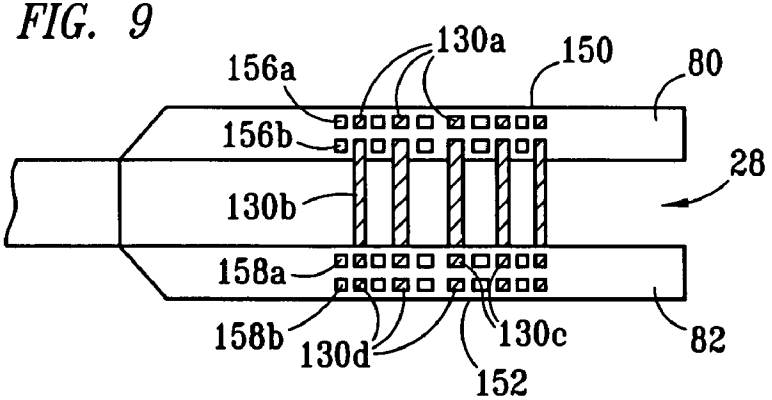
FIG. 9 is a partial cut-away side view of the splined pin engaged within the orifices in the locked position.

FIG. 9 is an enlarged partial cut-away side view of the splined cylinder 44 engaged within the orifices 32 and 34 in the locked position, while bosses 80 and 82 and the attached member 18 are not shown. The splined portion 130*b* is positioned partially with the gap 28. However, a portion of the splined portion 130*b* engages the splined row 156*b*. In addition, the splined portion 130*z* engages the splined row 156*a*. The splined portion 130*c* engages the splined row 158*a* and the splined portion 130*d* engages the splined row 158*b*. In this position, the splined cylinder 44 prevents any rotational movement between the ratchet head 12 and the handle 14.

FIG. 10 is a side view of the splined pin assembly 16 with the plunger 36 in a depressed and unlocked position. With downward force being applied to the planar member 52, the planar member 52 is positioned directly adjacent the circular flange 66.

Figure 11:
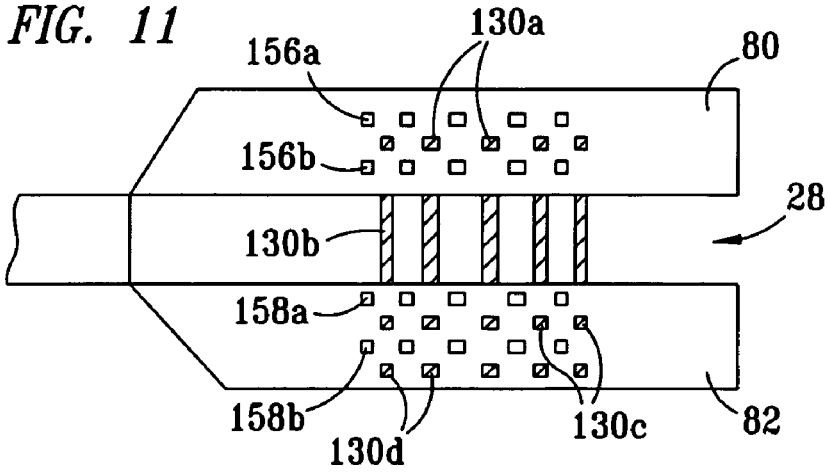
FIG. 11 is a partial cut-away side view of the splined pin engaged within the orifices in the unlocked position.

FIG. 11 is an enlarged partial cut-away side view of the splined cylinder 44 engaged within the orifices 32 and 34 in the unlocked position, while bosses 80 and 82 and the attached member 18 are not shown. When the planar member 52 of the plunger 36 is depressed, the splined cylinder 44 is pushed down. The splined portion 130*b* is positioned within the gap 28. The splined portion 130*a* is positioned between the splined rows 156*a* and 156*b*. The splined portion 130*c* is positioned between the splined rows 158*a* and 158*b*. The splined portion 130*d* is positioned below the splined row 158*b*. In this position, the splined cylinder 44 allows rotational movement between the handle 124 and the ratchet head 12.

Figure 12:
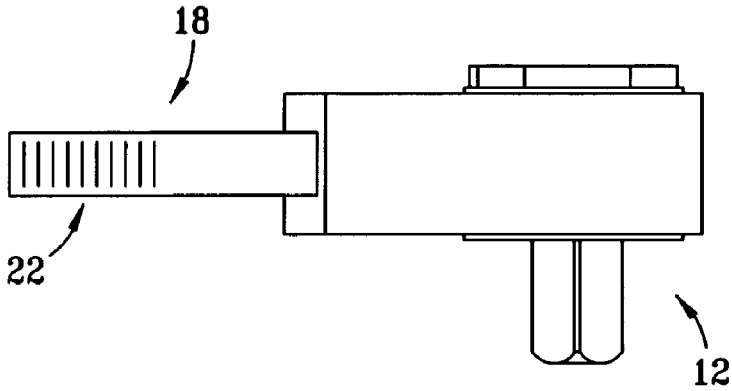
FIG. 12 is a partial cut-away side view of the ratchet member illustrating a splined orifice within the securing member.

FIG. 12 is an enlarged partial cut-away side view of the ratchet head 12 showing a splined orifice 22 within the attaching member 18. When positioned within the gap 28 between the upper prong 24 and the lower prong 26, the splined cylinder 44 engages the splined orifice 22. When the splined cylinder 44 is in the locked position, the attaching member 18 is unable to rotate in relationship to the handle 14. In the unlocked position, the attaching member 18 is free to rotate relative to the handle 14.

Figure 13:
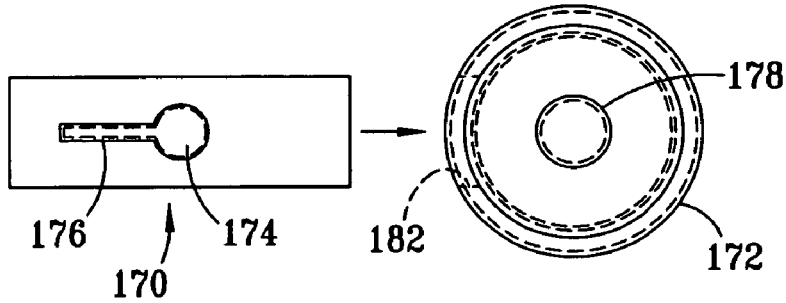
FIG. 13 is a top plan view of the boss, planar surface and a locking bar in an alternate embodiment of the present invention.
Figure 14:
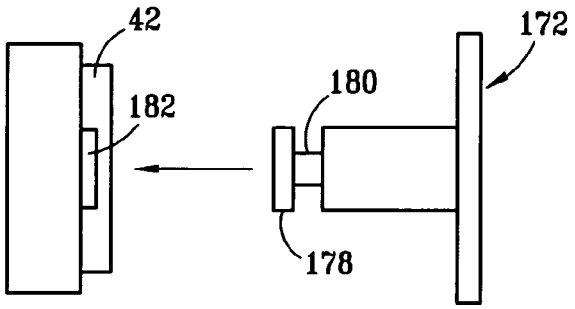
FIG. 14 is a side view of the plunger having an axial extension for use with a locking bar of FIG. 13.

FIGS. 13 and 14 show an alternative locking device which includes a locking bar 170 and a plunger 172. The locking bar 170 includes an opening 174 and a slot 176 extending from the opening 174. The plunger 172 includes a button 178 and a pine 180 attached to the button 178. The button 178 is sized to pass through the opening 174 and the pin 180 is sized to fit in the slot 176. The boss 82 includes an opening 182 for receiving the locking bar 170. To operate the alternative locking device, the user moves the locking bar 170 through the opening 182 with opening 174 and a portion of the slot 176 disposed above the planar member 52. The plunger 172 is aligned with the opening 174 so that the button 2178 can be pushed downwardly against the planar member 52 to depress the splined cylinder 44. As the button 178 moves downwardly, the user moves the locking bar 170 laterally to capture the pine 180 in the slot 176 with the button 178 disposed against the bottom surface of the locking bar 170. Thus the button 1278 is prevented from moving upwardly by the locking bar 170 thereby applying a continuous force against the planar member 52.

FIGS. 1–11 illustrate the operation of the indexable wrench 10. The splined pin assembly 16 typically remains in a locked position where the splined cylinder 44 is pressed upwardly by the coil spring 38. In the locked position, the splined cylinder 44 with its associated splined portions 130*a*, 130*b*, 1320*c* and 130*d* engage the splined rows located within the splined orifices 150 and 152 which prevents the rotational movement of the ratchet head 12 relative to the handle 14.

When the ratchet head 12 is to be rotated to another position, the planar member 52 of the plunger 36 is depressed. The splined cylinder 44 moves downwardly to a position where the splined portions of the splined cylinder 44 are disengaged from the splined rows of the splined orifices 32 and 34. When the splined are disengaged, the ratchet head 12 is allowed to rotate relative to the handle 14. When the desired position of the ratchet head 12 is reached, the plunger 36 is released thereby locking the ratchet head 12 in place. When the splined pin assembly 16 is to be unlocked for a period of time, the locking device 40 may be utilized to provide constant downward force to the plunger 36. The eccentric cam 92 is moved forward to position the cam lobe 922 directly above the planar member 52. By moving the actuator 94 in the slot 96, the cam lobe 922 engages and depresses the plunger 36 to move the splined cylinder 44 to the unlocked position. One advantage of the locking device 40 is that a user can unlock and lock the indexable wrench 10 in small areas where constant depression by the user's finger is not desired or possible or which may be convenient.

The indexable wrench 10 provides many advantages over existing indexable wrenches. Wrench 10 utilizes the spring-loaded splined pin assembly 16 to lock and unlock two members of the wrench 10 in a desired position. By utilizing the axial retainer 42 as well as the dual prongs 24 and 26 of the handle 14, the splined pin assembly 16 does not bind. The axial retainer 42 keeps the splined pin assembly 16 aligned within the orifices 32 and 34 of the prongs 24 and 26. Essentially the plunger 36 captively floats within the axial retainer 42 to prevent binding.

Existing indexable wrenches suffer from continual binding and difficulty in locking and unlocking their couplers. By utilizing a spring-loaded splined pin assembly 16 and the locking device 40, the indexable wrench 10 may be easily locked and unlocked. Further the coupling mechanism in wrench 10 is much stronger than couplers in existing conventional wrenches due to the dual prongs 24 and 26. In existing couplers, two members are joined together by a pin being positioned within two orifices. However, this existing configuration only provides for one shear point, while wrench 10 provides two shear points.

Bosses 80 and 82 of the wrench of the present invention also provide a degree of protection from impact to coupler 22 when the wrench is inadvertently dropped. Additionally, the upper boss 80 provides protection against accidental disengagement of the coupler. Although an indexable wrench has been used in describing the splined pin assembly 16, any two members that are rotatably joined may be used. Additionally, variations in the size number and shape of the splined and channels may be used for the splined pin assembly 16.

Figure 15:
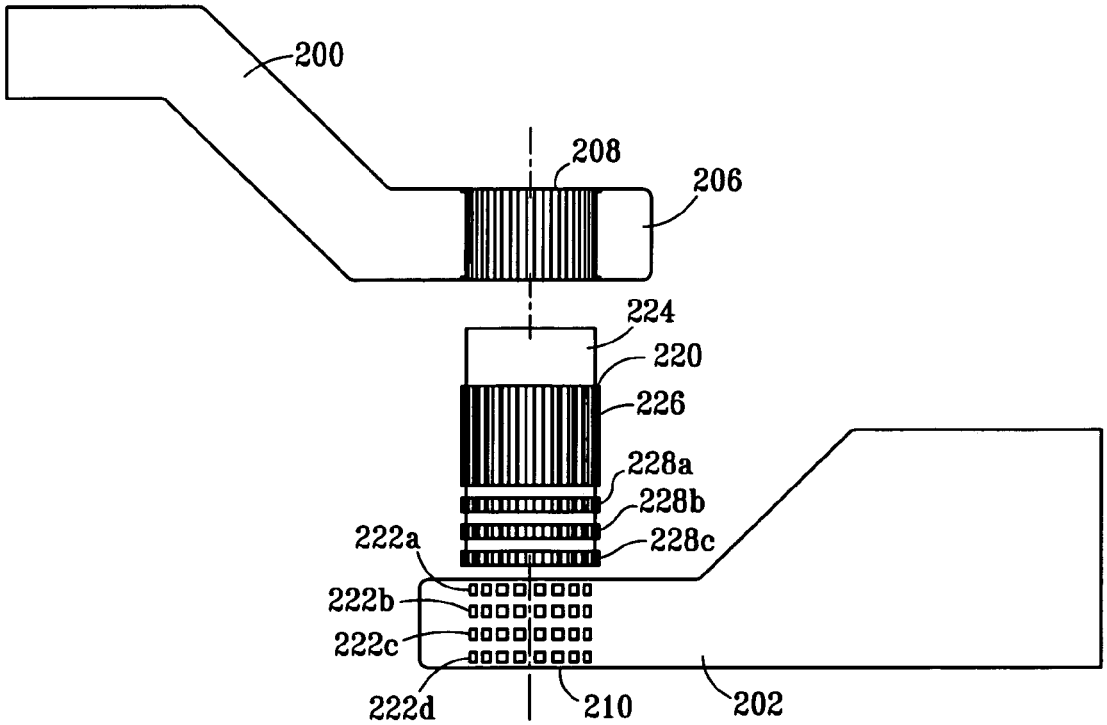
FIG. 15 is a partial cut-away side view of two members in an alternate embodiment of the present invention.

FIG. 15 is a partial cut-away side view of two members 200 and 202 in an alternate embodiment of the present invention. A splined cylinder 220 may be utilized to join the members 200 and 202. The splined cylinder includes a plurality of longitudinally extending external spleens divided by circumferential grooves. The grooves divide the splines into splined portions 226, 228*a*, 228*b* and 228*c*. The splined cylinder also includes a smooth portion 224. The x cylinder 220 is very similar to the cylinder 44 with the exception of the smooth portion 224 and an additional splined portion 228*c*. In this alternate embodiment, the member 200 has only one prong 206 with a splined orifice 208. The second member 202 has a splined orifice 210. The splined orifice includes four splined rows 22*a*, 222*b*, 22*c* and 222*d*. The splined cylinder 220 is positioned and operated in the same manner as described above for the splined cylinder 96.

In a further embodiment, an indexing mechanism for an indexable tool is disclosed in FIGS. 19–32. This mechanism utilizes a splined pin release and can be used in either a vertical or horizontal position on the tool. The indexable mechanism is useful with a tool having a tool handle joined to a tool member with the indexing mechanism being adapted to enable indexing the tool member and the tool handle to adjusted positions. The indexing mechanism comprises: an indexing member and a tool handle joined to a tool member with the indexing mechanism being adapted to enable releasing the handle and the tool for rotationally indexing the tool member and the tool handle to selected positions in which the tool member and handle are locked in position. The indexing mechanism comprises: a) a first splined orifice having a splined section on its inner surface and having a width less than the length of the first orifice and on a first end of the first splined orifice; b) a second splined orifice having a splined section on its inner surface and having a width less than the length of the second orifice and a first end of the second orifice; c) third splined orifice having splines on its inner surface and being positioned between the first orifice and the second orifice; d) a splined pin assembly positioned in the third splined orifice to engage the splines on the inside surface of the third orifice and on the splined sections of the first and second orifices when in an engaged position and to disengage from the splined sections of a first and second orifices when in the released position, the splined pin assembly comprising; 1) a splined pin having a first end and a second end, a first spline section and a second splined section separated by a first track and a plurality of extension arms on its second end, an outside of the extension arms forming a second track surface around the outside of the splined pin to form a second track around the splined pin; 2) an alignment member having a plurality of extended arms positioned to matingly engage the extension arms on the second end of the splined pin and having a connector receptacle; 3) a spring positioned in the splined pin; 4) a first end cap having on its inside an extension slideably connected to the alignment member; 5) a second end cap having an inside, a lip on its inside, an extension adapted to engage the spring so that the spring is in compression between the second end cap and the splined pin and a opening in the second end cap for a connector connecting the second end cap to the alignment member; and, 6) a connector connecting the second end cap to the alignment member wherein the first splined section is urged into the first track and the second splined section is urged into the second track when the second end cap is moved toward the first end cap to release the splined indexing mechanism, release of the first and second end caps returning the indexing mechanism to its engaged position.

Figure 19:
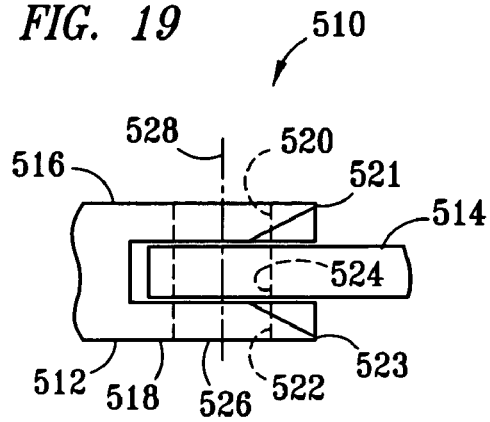
FIG. 19 is a top view of first and second members, including first and second splined orifices and a third member containing a splined orifice in position and connected by a splined pin, according to the present invention.

As shown in FIG. 19, a tool coupling 510, including the indexing mechanism of this embodiment is shown. The tool coupling includes a first member 512 and a second member 514. Member 512 may be either a tool handle or a tool member such as a ratchet head, pry bar surface, wrench, or the like. A second member 514 is positioned between a first extension 516 and a second extension 518 positioned on first member 512 to accept a second member 514 between first extension 516 and second extension 518. A splined pin 526 is positioned through a first splined orifice 530 in extension 516, a second splined orifice 522 in extension 518, and a third splined orifice 524 in second member 514. Splined pin 526 engages the first, second and third splined orifices. While discussed more detail below, the splined pin can be moved into and out of engagement with the splined orifices in the first and second extensions to enable adjustment of the tool relative to the handle.

Figure 20:
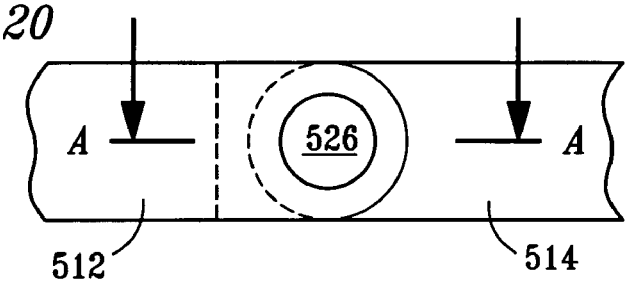
FIG. 20 is a side view of the A embodiment shown in FIG. 19A.

FIG. 20 shows a side view of the embodiment shown in FIG. 19.

Figure 21:
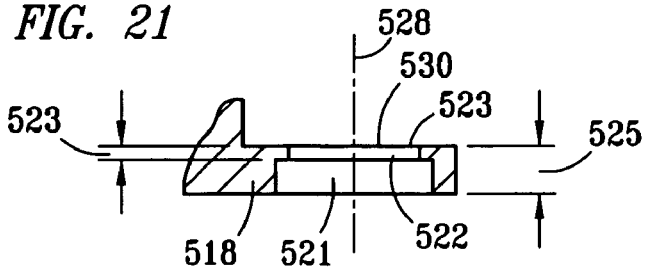
FIG. 21 is a top view taken at line AA of an orifice in a first extension showing a splined section in the splined orifice in the extension A.

In FIG. 21 a top view of second splined orifice 522 in extension 518 is shown and includes an inner diameter surface 521, has a width 525 and a splined section 530 is positioned on an inner portion 523 of first splined orifice 522.

Figure 22:
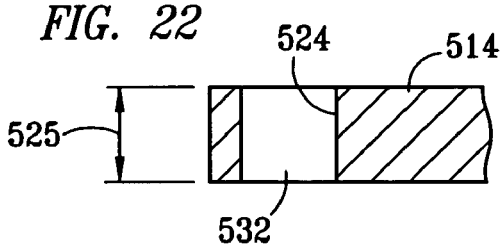
FIG. 22 is a top view taken at line AA of the splined orifice in a third member A.

FIG. 22 is a top view of second member 514 taken at line AA in FIG. 20 and shows an inside of third splined orifice 524, which includes splines 532 across its entire length 527. First, second and third orifices are coaxially positioned with an axis 528.

Figure 23:
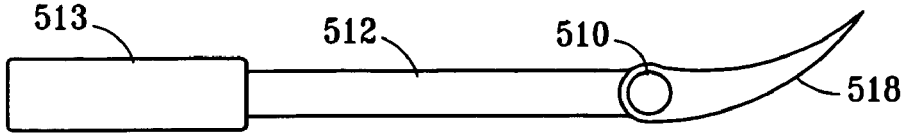
FIG. 23 is a side view of a tool, including an indexing mechanism according to the present invention.

FIG. 23 shows a tool, including an embodiment of the present invention. In the tool, handle 512 is shown as the first member with a tool comprising a pry bar being shown as second extension 518. A gripping surface 513 is shown on handle 512. An indexing mechanism 510 is shown to enable rotation of the tool member and the handle relative to each other. In this embodiment, the two extensions are positioned on the tool member.

Figure 24:
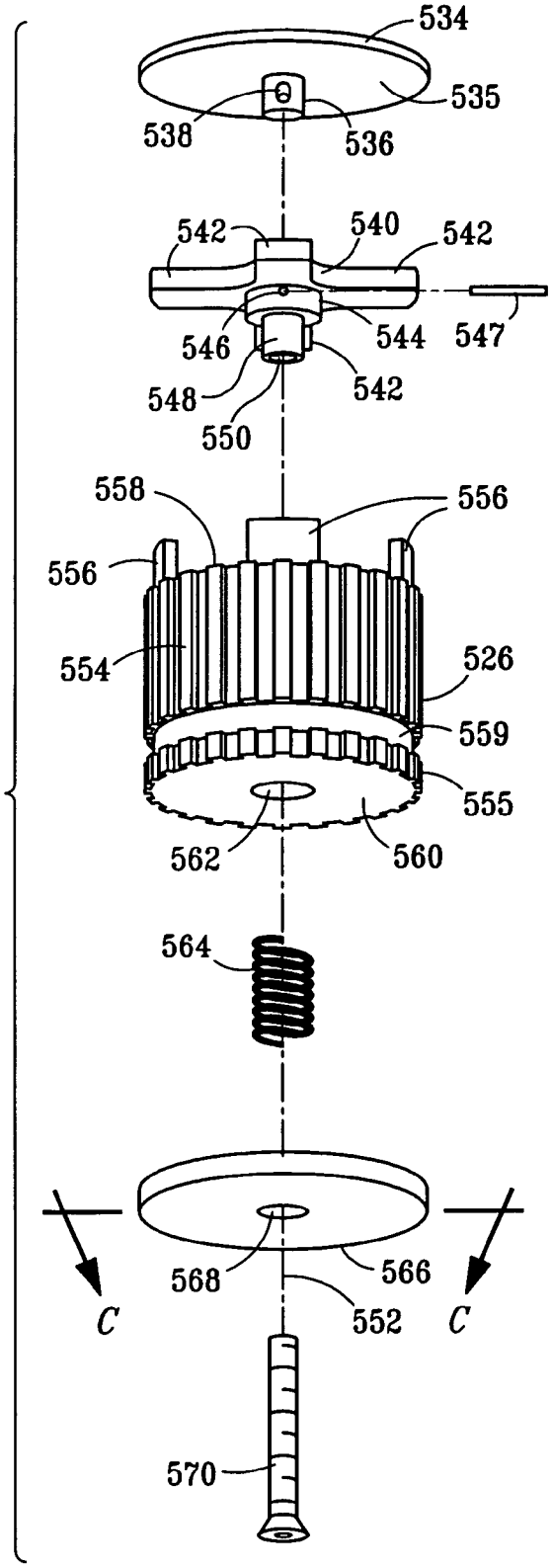
FIG. 24 is an exploded view of an embodiment of the connector pin assembly of the present invention A.

In FIG. 24 an exploded view of the component parts of the indexing mechanism is shown. The indexing mechanism includes a first end cap 534, which has an inside 535 bearing an extension 536, including a slot 538, which is an elongated slot for subsequent engagement with a pin 547 to maintain first end cap 534 in alignment with an alignment member 540. Alignment member 540 includes a plurality of extensions 542, extending outwardly to a diameter slightly greater than a diameter 537 of splined portions 530 but less than an inside diameter of the non-splined portions of first splined orifice 520 and second splined orifice 522. A plurality of extensions may be used and, as shown, four extensions are used. The slot is positioned to enable splined pin 526 to move toward and away from first end cap 534.

Alignment member 540 includes extensions 542 as noted on its sides. An extension 544 is positioned on a side of alignment member 540 away from first end cap 534. This extension is a generally circular extension and includes a hole 546 as a receptacle for pin 547 to slideably position alignment member 540 on extension 536. A second extension 548 extends from extension 544 and includes a threaded opening 550 in its opening most removed from first end cap 534.

Splined pin 526 includes a first splined section 554 and a second splined section 555 with a track 559 positioned between first splined section 554 and second splined section 555. Splined pin 526 also includes on its first end 558 a plurality of extensions 556 positioned to matingly engage extensions 542 on alignment member 540. The splined pin includes a second end 560 and an opening 562 adapted to receive a spring 564. A second end cap 566 is positioned to compress spring 564 into opening 562 to bias splined pin 526 away from second end cap 566. Second end cap 566 includes an opening 568 positioned around an axis 572 and adapted to receive a screw 570. The component parts are axially positioned around an axis 572.

Figure 25:
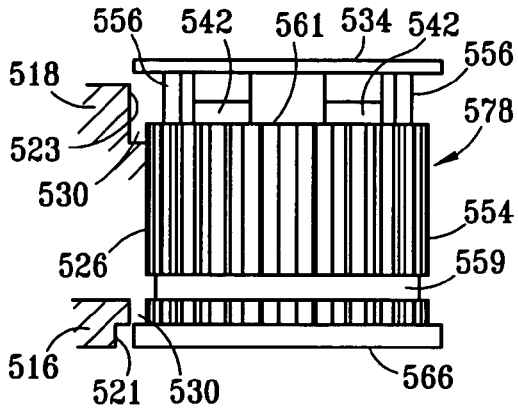
FIG. 25 is a side view of am embodiment of the indexing mechanism of the present invention in its configuration in an engaged position in first, second and third splined orifices A.

In FIG. 25, the indexing mechanism of the present invention is shown in its engaged position. Splined sections 530 on the inside of the first and second splined orifices engage first splined section 554 and second splined section 555 on splined pin 526. In this position the tool and handle are locked together and movement is prevented. It will be noted that extensions 542 are adjacent to an end 561 of splines 554. The splined sections on the first and second splined orifices are shown at 530.

Figure 26:
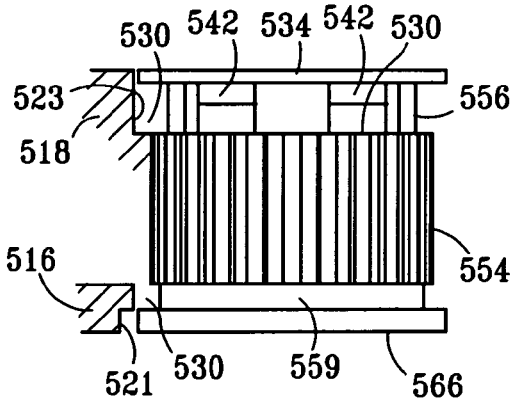
FIG. 26 is a side view of an embodiment of the indexing mechanism of the present invention in its released position in first, second and third orifices.

In FIG. 26, the indexing mechanism of the present embodiment is shown in a released position. First end cap 566 is urged toward second end cap 534 and pushes the splined sections on the inside of the first splined orifice and the second splined orifice into first track 559 and a second track 580 created by movement of extensions 542 away from the end of splines 554. In these two tracks the spline sections are positioned in the first and second tracks and do not engage splines on the splined pin and the tool and handle are rotatable relative to each other. It is desirable to prevent binding of the spline sections 530 in each of the tracks so desirably a clearance space of about 0.005 inches on each side of each spline section in each track.

Figure 27:
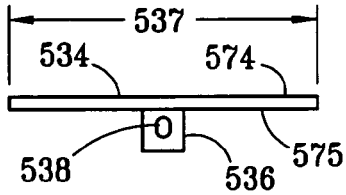
FIG. 27 a view of an embodiment of a top cap A.

In FIG. 27, a cross-sectional view of first end cap 534 is shown. First end cap 534 includes a first side 574 and a second side 576. Extension 536 is shown having a slot 538 sized to permit movement of alignment member 540 sufficiently toward first end cap 534 to permit movement of the extensions 542 away from splines 554 to create second track 580, as discussed above.

Figure 28:
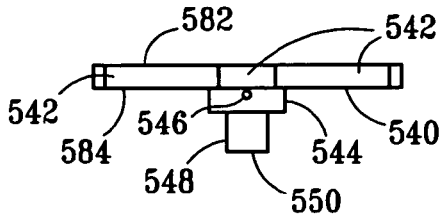
FIG. 28 is a view of an embodiment of an alignment member A.

FIG. 28 is a cross-sectional view of alignment member 540. Alignment includes a plurality of extensions 542 on its first side 582 and on its second side 584 includes an extension 544 including an opening 546 fastened by a pin passing through an opening 546 and slot 538 so that extension 536 can extend into an opening in first end 582 of alignment member 540. Alignment member 540 also includes a second extension 548 from extension 544 including in its end portion a threaded opening 550.

Figure 29:
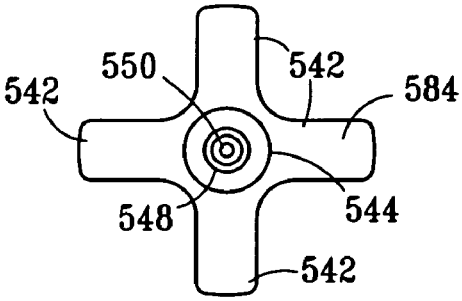
FIG. 29 is a top view of an embodiment of the alignment member, according to the present invention.

In FIG. 29, an end view of alignment member 540 is taken from its end nearest splined section 554 on the splined pin. The threaded opening 550 is shown as well as second extension 548 and extension 544.

Figure 30:
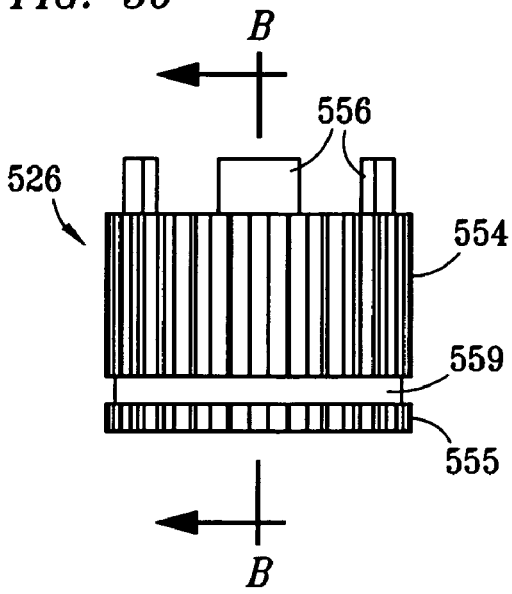
FIG. 30 is a side view of an embodiment of an alignment pin, according to the present invention.
Figure 31:
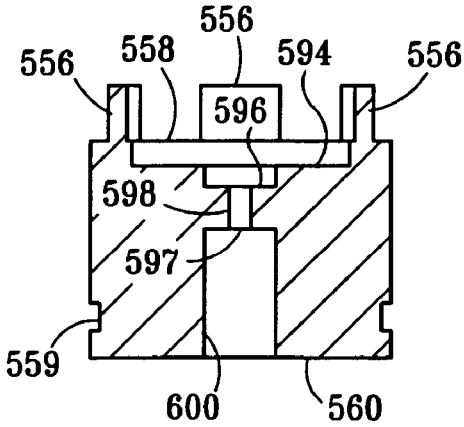
FIG. 31 is a cross-sectional view of the embodiment of the splined pin of the present invention shown in FIG. 30; and, FIG. 32 is a cross-sectional view of an embodiment of a second end cap, according to the present invention.

In FIG. 30 is a side view of a splined pin is shown. Splined pin 526 includes splines 554 in a first section which is wider than splines in a second section 555 separated from the splines in the first section by a first track 559. A plurality of extensions 542 are shown on first end 558 of splined pin 526. These extensions are positioned to matingly engage extensions 542 on the alignment member 540. These extensions have an outer diameter substantially the same as first track 559. This permits rotation of the splined sections 530 on the extensions 556 in those tracks without restriction. Splined pin 526 includes an opening 594, a second opening 596 and a third opening 598 with a fourth opening 600 extending from an end 597 of third pin opening 596 to second end 560 of splined pin 526 as shown in the cross-sectional view of the splined pin in FIGS. 30 and 31.

Figure 32:
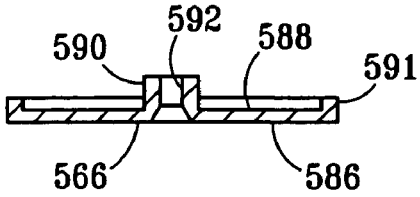

FIG. 32 is a cross-sectional view of second end cap 566, which includes an outer surface 586, an inside surface 588 and includes an extension 590 penetrated by a threaded opening 592 extending through second end cap 566 to its outside end 586. Second end cap 566 also includes a lip sized to cover splines 555 when the indexing mechanism is in its released position.

The use of the alignment member prevents sticking and binding of the coupling member in either the engaged or disengaged position. The use of this configuration presents an extremely compact and convenient mechanism for releasing and rotating the handle and tool member relative to each other. As previously indicated, the first member may be either a tool handle or a tool member and the second member may be either a tool member or a tool handle. In other words, the presence of two extensions on either of the tool member or the handle member is equally suitable. As shown in FIG. 1, the extensions are positioned on a first member which may be either a tool member or a handle. In FIG. 23, the extensions are positioned on the tool member. Either positioning is acceptable.

In either event, the disengagement of the indexing member requires only that the end caps be pushed toward each other. This results in an effective locking mechanism which is very easily released and which by reason of the combination of the alignment member with the splined pin extensions results in no binding. The device of the present invention is very durable and is very conveniently used. The end caps may be positioned on opposite sides of the tool horizontally or vertically as desired.

The splines may be of any convenient size and are generally of approximately the same height and width. Considerable variation in the configuration of the splines is possible and is within the scope of the present invention. Similarly, the size of the components comprising the indexing mechanism may vary substantially depending upon the size of the tools constructed.

It has been found that while the splined sections on the inside of the extensions are relatively small in area relative to the entire splined area of the splined 10, that they provide more than adequate strength for tools where any indexing mechanism is used. Of course, the splined components of the invention are sized relative to the size of the tool in which they are used.

This embodiment is effective, convenient, long-lived and provides for reliable and convenient release and re-engagement of tool components dependably and conveniently.

As the tool coupling is assembled, first end cap 534 is connected to alignment member 540 by pin 547 as discussed above through hole 546 and slot 538. Alignment member 540 and the extensions 542 positioned on the splined pin are positioned in a first splined orifice outside the splined section on the first splined orifice. The splined pin is then positioned through the first and second splined orifice and the third splined orifice to engage extension 548 with opening 598 in splined pin 526. The extensions 542 on alignment member 540 are outside the splined section 530 on the first splined orifice. Spring 564 is then placed in opening 600 in splined pin 526 and second end cap 566 is connected to second extension 548 on the alignment member by a screw 570. When the screw is tightened, alignment member 540, spring 562 and second end cap 566 are engaged with spring 562 biasing second end cap 566 and splined pin 526 apart.

As assembled, the connector is used by depressing first end cap 534, which depresses extensions 556 and splined pin 526 toward second end cap 566. This moves track 559 into position to move one of the splined sections on second splined orifice 522 out of engagement with splines 553 and moves the splined section 554 out of engagement with the splined section 530 on second splined orifice 523. The extensions 556 are not depressed sufficiently far that they move out of engagement with extensions 542 on alignment member 540. Thus, the splined pin 526 is held in alignment by alignment member 540 as it is depressed toward second end cap 566 to disengage the indexing mechanism and moves back toward and away from second end cap 566 to return the tool to an engaged position.

It will be observed that second end cap 566 and alignment member 540 do not move relative to each other. The splined pin 526 is depressed by engagement with first end cap 534 to disengage the tool and move back into engagement by releasing first end cap 534. As indicated previously, the splined pin 526 includes extensions 556, which remain in engagement with extensions 542 on alignment member 540 so that the splined pin 526 is always maintained in alignment with the splined orifices.

In the embodiment shown, it is clear that the second end cap 566 and the alignment member 540 do not move relative to each other. All movement of the internal components is by the movement of the splined pin 526 as the result of depression of the first end cap 534. As noted previously, this permits the extensions on the first end of the splined pin 526 to remain in engagement with the extensions on the alignment member 540 so that the extensions on both remain engaged and prevent misalignment or jamming of the splines during engagement and disengagement of the tool. This presents a significant advantage over previous devices of this type.

While the present invention has been described by reference to certain of its preferred embodiments, it is pointed out that the embodiments described are illustrative rather than limiting in nature and that many variations and modifications are possible within the scope of the present invention. Many such variations and modifications may be considered obvious and desirable by those skilled in the art based upon a review of the foregoing description of preferred embodiments.

What is claimed is:

1. An indexing mechanism for an indexable tool, the tool having a tool handle joined to a tool member with the indexing mechanism being adapted to enable indexing the tool member and the tool handle to selected positions, the indexing mechanism comprising:

a) a first splined orifice having a first splined section on its inner surface and having a width less than the length of the first orifice and positioned on a first end of the first splined orifice;

b) a second splined orifice having a second splined section on its inner surface and having a width less than the length of the second orifice and positioned on a first end of the second orifice;

c) a third splined orifice having splines on its inner surface and being positioned between the first orifice and the second orifice;

d) a splined pin assembly positioned in the third splined orifice to engage the splines on the inside surface of the third orifice and the splined sections of the first and second orifices when in an engaged position and to disengage from the splined sections of a first and second orifices when in the released position, the splined pin assembly comprising;

1) a splined pin having a first end and a second end, a first splined section and a second splined section separated by a first track and a plurality of extension arms on its second end, an outside of the extension arms forming a second track surface around the outside of the splined pin to form a second track around the splined pin;
2) an alignment member having a plurality of extended arms positioned to matingly engage the extension arms on the second end of the splined pin and having a connector receptacle;
3) a spring positioned in the splined pin;
4) a first end cap having on it's inside an extension slideably connected to the alignment member;
5) a second end cap having an inside, a lip on its inside, an extension adapted to engage the spring so that the spring is in compression between the second end cap and the splined pin and a opening in the second end cap for a connector connecting the second end cap to the alignment member; and,
6) a connector connecting the second end cap to the alignment member wherein the first splined section is urged into the first track and the second splined section is urged into the second track when the first end cap is moved toward the second end cap to release the indexing mechanism, release of the first end cap returns the indexing mechanism to its engaged position.

2. The indexing mechanism of claim 1 wherein the first and second splined orifices are positioned on a tool handle and wherein the third splined orifice is positioned on a tool member.

3. The indexing mechanism of claim 1 wherein the first and second splined orifices are positioned on a tool member and wherein the third splined orifice is positioned on a tool handle.

4. The indexing mechanism of claim 1 wherein the connector is a screw.

5. The indexing mechanism of claim 1 wherein the extended arms are positioned outside a splined section in a first orifice.

6. The indexing mechanism of claim 1 wherein the extended arms and the second cap do not move relative to each other during the release or re-engagement of the indexing mechanism.

7. The indexing mechanism of claim 1 wherein the indexing mechanism is released and re-engaged by movement of the first end cap and the splined pin relative to the alignment member and the second end cap.

8. The indexing mechanism of claim 7 wherein the extended arms remain in engagement with the extension arms during engagement and disengagement.

9. A tool, including an indexing member, and comprising a tool handle joined to a tool member with the indexing mechanism being adapted to enable indexing the tool member and the tool handle to selected positions wherein the indexing mechanism comprises: an indexing mechanism for an indexable tool, the tool having a tool handle joined to a tool member with the indexing mechanism being adapted to enable indexing the tool member and the tool handle to selected positions, the indexing mechanism comprising:

a) a first splined orifice having a splined section on its inner surface and having a width less than the length of the first orifice and positioned on a first end of the first splined orifice;
b) a second splined orifice having a splined section on its inner surface and having a width less than the length of the second orifice and positioned on a first end of the second orifice;
c) a third splined orifice having splines on its inner surface and being positioned between the first orifice and the second orifice;
d) a splined pin assembly positioned in the third splined orifice to engage the splines on the inside surface of the third orifice and the splined sections of the first and second orifices when in an engaged position and to disengage from the splined sections of a first and second orifices when in the released position, the splined pin assembly comprising;
   1) a splined pin having a first end and a second end, a first spline section and a second splined section separated by a first track and a plurality of extension arms on its second end, an outside of the extension arms forming a second track surface around the outside of the splined pin to form a second track around the splined pin;
   2) an alignment member having a plurality of extended arms positioned to matingly engage the extension arms on the second end of the splined pin and having a connector receptacle;
   3) a spring positioned in the splined pin;
   4) a first end cap having on its inside an extension slideably connected to the alignment member;
   5) a second end cap having an inside, a lip on its inside, an extension adapted to engage the spring so that the spring is in compression between the second end cap and the splined pin and a opening in the second end for a connector connecting the second end cap to the alignment member; and,
   6) a connector connecting the second end cap to the alignment member wherein the first splined section is urged into the first track and the second splined section is urged into the second track when the first end cap is moved toward the second end cap to release the indexing mechanism, release of the first end cap returns the indexing mechanism to its engaged position.

10. The indexing mechanism of claim 9 wherein the first and second splined orifices are positioned on a tool handle and wherein the third splined orifice is positioned on a tool member.

11. The indexing mechanism of claim 9 wherein the first and second splined orifices are positioned on a tool member and wherein the third splined orifice is positioned on a tool handle.

12. The indexing mechanism of claim 9 wherein the connector is a screw.

13. The indexing mechanism of claim 9 wherein the extended arms are positioned outside a splined section in a first orifice.

14. The indexing mechanism of claim 9 wherein the extended arms and the second cap do not move relative to each other during the release or re-engagement of the indexing mechanism.

15. The indexing mechanism of claim 9 wherein the indexing mechanism is released and re-engaged by movement of the first end cap and the splined pin relative to the alignment member and the second end cap.

16. The indexing mechanism of claim 15 wherein the extended arms remain in engagement with the extension arms during engagement and disengagement.

* * * * *